United States Patent [19]

Fujimori et al.

[11] Patent Number: 4,780,827

[45] Date of Patent: Oct. 25, 1988

[54] APPARATUS FOR CONTROLLING IDLING OPERATION OF AN INTERNAL COMBUSTION ENGINE

[75] Inventors: Kyoichi Fujimori; Akira Sekiguchi, both of Higashimatsuyama, Japan

[73] Assignee: Diesel Kiki Co., Ltd., Tokyo, Japan

[21] Appl. No.: 839,933

[22] Filed: Mar. 17, 1986

[51] Int. Cl.[4] ..... F02B 3/12

[52] U.S. Cl. ..... 364/431.07; 364/431.05; 364/431.11; 123/339; 123/352

[58] Field of Search ..... 364/431.07, 431.08, 364/431.05, 431.11; 123/357, 352, 339, 436

[56] References Cited

U.S. PATENT DOCUMENTS

| | | | |
|---|---|---|---|
| 4,294,216 | 10/1981 | Abo et al. | 123/489 |
| 4,476,833 | 10/1984 | Johnson et al. | 123/436 |
| 4,520,779 | 6/1985 | Kubach | 123/357 |
| 4,535,406 | 8/1985 | Johnson | 364/431.05 |
| 4,541,380 | 9/1985 | Oshizawa et al. | 123/357 |
| 4,577,718 | 3/1986 | Ueno | 123/352 |

FOREIGN PATENT DOCUMENTS

| | | | |
|---|---|---|---|
| 0176424 | 10/1983 | Japan | 123/436 |
| 0085432 | 5/1984 | Japan | 123/436 |

*Primary Examiner*—Parshotam S. Lall
*Attorney, Agent, or Firm*—James Creighton Wray

[57] ABSTRACT

In the closed-loop control system responsive to an average speed of a multi-cylinder internal combustion engine for obtaining a target idling engine speed, there is provided an optically activatable individual cylinder control system for eliminating the difference between the outputs of the respective cylinders. The closed-loop control system has a data processing circuit for processing control data for the closed-loop control system and enabling the use of the closed-loop control system for at least proportional and integral control, and the control constant used in the data processing circuit is changed depending upon whether or not the individual cylinder control system is used, whereby stable individual cylinder control can be realized.

19 Claims, 9 Drawing Sheets

APPARATUS FOR CONTROLLING IDLING OPERATION OF AN INTERNAL COMBUSTION ENGINE

BACKGROUND OF THE INVENTION

The present invention relates to an idling operation control apparatus for an internal combustion engine, more particularly to an idling operation control, apparatus for regulating fuel supply for every cylinder so as to minimize the dispersion of the output among the respective cylinders of a multiple cylinder engine and to assure the stable engine operation.

In the control of the amount of fuel injection in a multiple cylinder engine according to the prior art, the fuel injection amount is uniformly controlled for all the cylinders. Accordingly, the output of the respective cylinders is not equal due to differences within the manufacturing tolerance of the internal combustion engine and/or the fuel injection pump and the like.

In particular, non-uniform output among the cylinders causes striking degradation in the stability of the engine operation during the idling operation of the engine, and this in turn increases the amount of harmful components included in the exhaust gas, thus producing engine vibration. In addition, disadvantages such as noise are liable to be generated by the vibration of the engine.

In order to overcome the above disadvantages, there have been proposed various apparatuses for controlling the fuel to be injected into each cylinder of the engine by means of an individual cylinder control system.

The inventors have also been proposed an improved individual control system in which the system has a closed-loop system for controlling an average engine speed and a second closed-loop system for controlling the fuel to be injected into each cylinder of the engine and the second closed-loop system can selectively be used (U.S. patent application Ser. No. 779,222).

However, since the control constants in the first closed-loop system is set a constant in the proposed system regardless of whether or not the second closed-loop system is used, it sometimes occurs that the stability of the operation of the individual control system is lowered even further when the second closed-loop system is used.

SUMMARY OF THE INVENTION

It is therefore an object of the present invention to provide an improved apparatus for controlling the idling operation of an internal combustion engine by employing an individual cylinder control system.

It is another object of the present invention to provide an apparatus for controlling the idling operation of an internal combustion engine in which the idling operation can be performed in a highly stable condition regardless of whether or not a control system for individual cylinder control is used in a closed-loop control system for controlling the average speed of an internal combustion engine.

It is a further object of the present invention to provide an apparatus for controlling the idling operation of an internal combustion engine according to the individual cylinder control system in which the idling operation can stably be performed with less fuel consumption.

It is a still further object of the present invention to provide an apparatus for controlling the idling operation of an internal combustion engine according to the individual cylinder operation system in which engine vibration can be further decreased.

According to the present invention, in an apparatus for controlling the idling operation of an internal combustion engine, the apparatus comprises a closed-loop control system having a first output means for producing average speed data indicating the average engine speed of a multi-cylinder internal combustion engine, a second output means for producing target speed data indicating a predetermined target idling engine speed, a first calculating means responsive to the average speed data and the target speed data for producing first control data relating to the fuel amount to be supplied to the engine so as to obtain the target idling engine speed, a processing means for processing the first control data and enabling use of the closed-loop control system for at least proportional and integral (PI) control, and a controlling means responsive to the output from the processing means for controlling a speed regulating means so as to carry out closed loop control for the idling engine speed. The apparatus further comprises a detecting means for detecting the operation timing of said engine, a first means responsive to the output of the detecting means for producing first data relating to the output of the respective cylinders of the engine, a second means responsive to the first data for repeatedly calculating and producing differential data for each of the cylinders successively, the differential data being related to the difference between the outputs of the respective cylinders and a predetermined reference value, a second calculating means responsive to the differential data for calculating and producing second control data relating to the fuel amount required for eliminating the difference indicated by the differential data, an output control means responsive to the output of the detecting means for outputting the second control data at a predetermined time before the ensuing regulation of fuel going to each of the cylinders, a control means for controlling the supply of the second control data from the output control means to the closed-loop control system to carry out ON/OFF control of the individual cylinder control mode, and a changing means for changing a control constant in the processing means in response to the ON/OFF state of the individual cylinder control operation.

With the construction described above, a feedback control loop for controlling fuel quantity so as to reduce the differences among the outputs of the cylinders to zero may be provided in a feedback control loop for controlling the engine speed in such a way that the average engine speed is made equal to the desired idling engine speed. When the individual cylinder control operation is carried out, the amount of fuel injection is controlled in such a way that the differential data is made zero. Thus, it becomes possible to maintain the amplitude of the change in the angular speed of the internal combustion engine. Consequently, the magnitude of the vibration in the internal combustion engine can be reduced and the idling engine speed can be also lowered because the noise level will be degraded. Furthermore, when the individual cylinder control is carried out, the coefficients which are used for PI control calculation in a PI control calculator provided in the closed-loop control system are changed in such a way that the PI control condition is adapted to the individual cylinder control mode. As a result, the individual cylinder control operation can be performed in a more stably. This results in more stable engine operation with less fuel consumption.

The invention will be better understood and other objects and advantages thereof will be more apparent from the following detailed description of preferred embodiments with reference to the accompanying drawings.

DESCRIPTION OF THE PREFERRED EMBODIMENTS

Figure 1A:
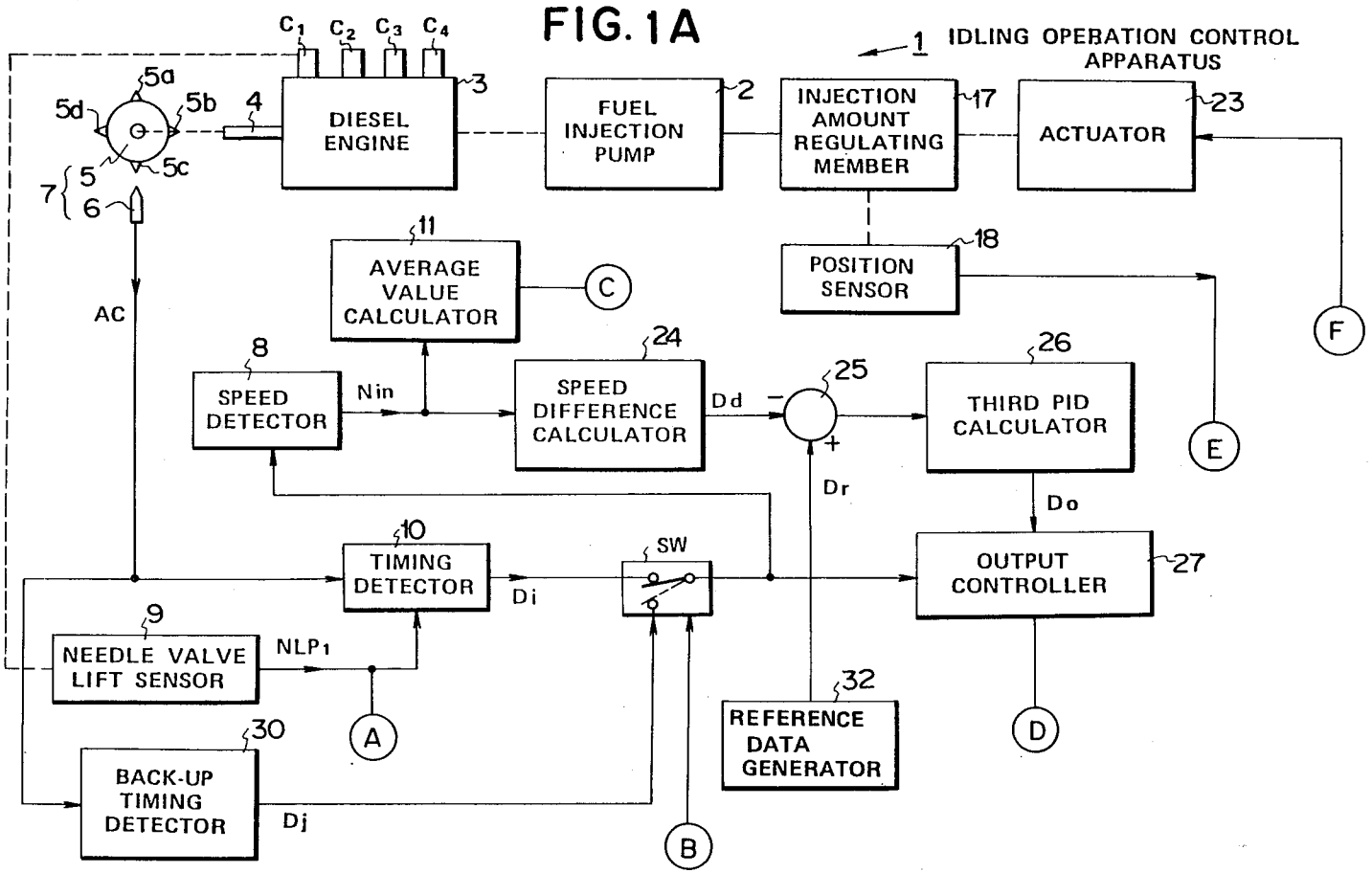
FIGS. 1A and 1B constitute a block diagram showing an embodiment of an idling operation control apparatus according to the present invention.
Figure 1B:
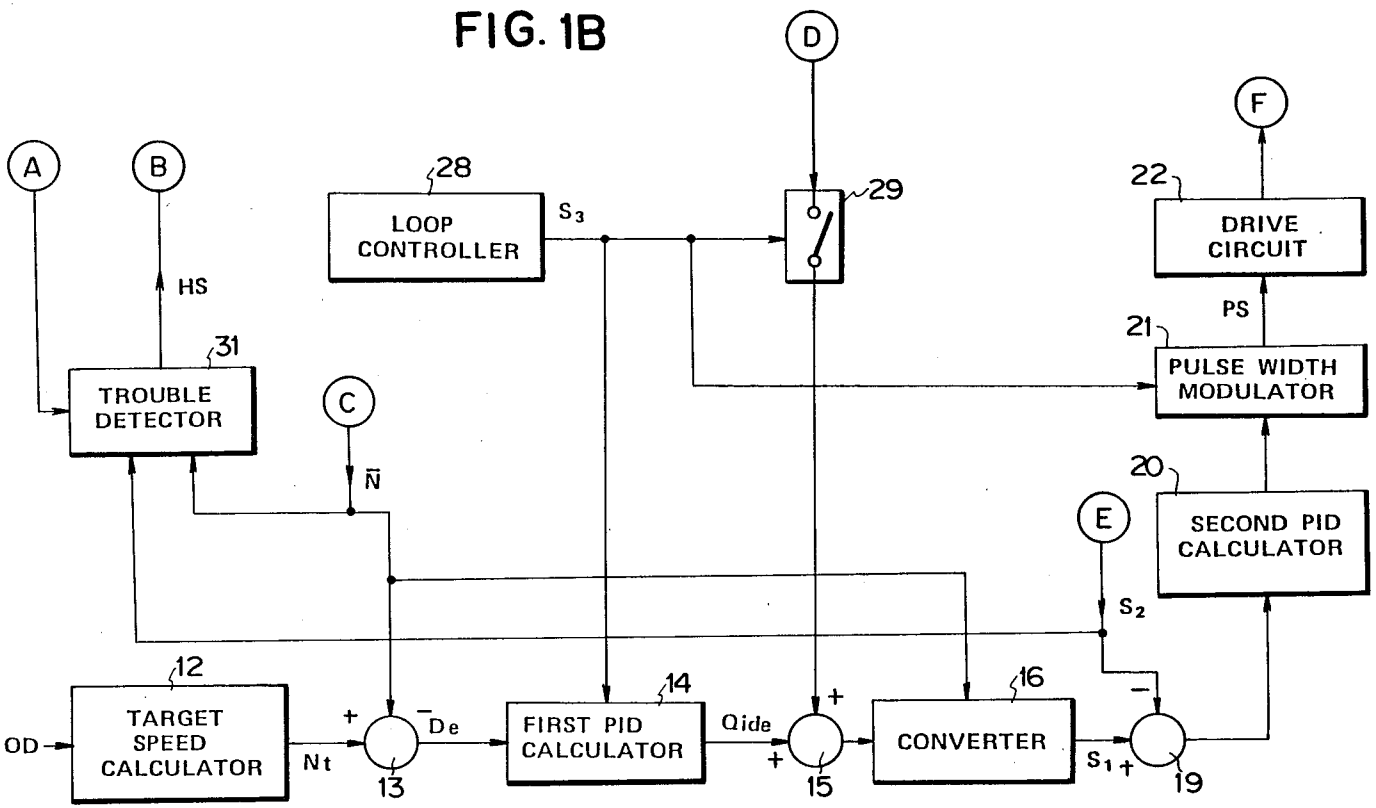

FIG. 1 is a block diagram of an idling operation control apparatus for an internal combustion engine according to the present invention, as applied to idling operation control of a diesel engine. A diesel engine 3 is supplied with fuel by injection from a fuel injection pump 2, and the idling operation control apparatus 1 serves to control the speed of rotation of the engine 3 during idling.

A rotation sensor 7 is provided to detect when the crankshaft 4 of the diesel engine 3 has reached a predetermined reference position. The rotation sensor 7 is of a known design, consisting of a pulser 5 and an electromagnetic pick-up coil 6. Since the diesel engine 3 is of the four-cycle four-cylinder type in the embodiment shown in FIG. 1, a set of cogs, 5*a* to 5*d*, is formed around the periphery of pulser 5, with an angular spacing between the cogs of 90°. The positional relationship between pulser 5 and the crankshaft 4 is such that when the pistons in two of the four cylinders of diesel engine 3 reach the top dead center position, cog 5*a* or 5*c* is disposed immediately opposite electromagnetic pick-up coil 6.

Figures 2A, 2B, 2C, 2D, 2E, 2F, 2G:
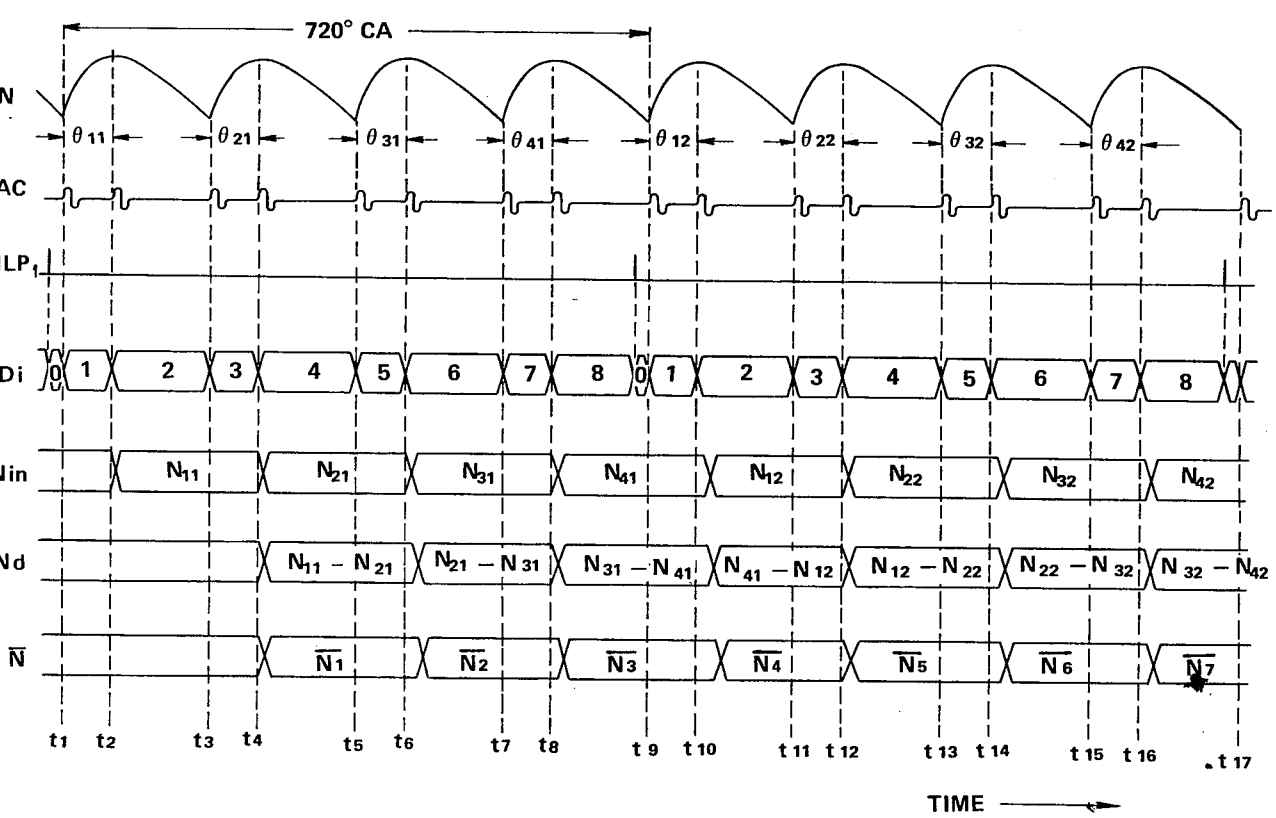
FIGS. 2A to 2G are timing charts for explaining the operation of the apparatus shown in FIG. 1.

FIG. 2A shows the instantaneous speed N of rotation of diesel engine 3, and FIG. 2B shows the waveforms of an a.c. signal designated as AC which is produced by rotation sensor 7. Each time a cog becomes positioned opposite electromagnetic pick-up coil 6, the a.c. signal AC changes in level from positive to negative polarity, so that a waveform made up of pairs of pulses each comprising a positive pulse followed by a negative pulse are produced. The timings $t_1, t_3, t_5, \ldots t_{17}$ of the rising-up points of positive peaks correspond to the top dead center timings of the pistons in the diesel engine 3. Timings $t_2, t_4, \ldots t_{16}$ correspond to the indicated timings at which the crankshaft 4 has rotated through an angle which is greater than 90°, after passing the top dead center position. On the other hand, the timings $t_1, t_3, t_5, \ldots t_{17}$ of the minimum points of the instantaneous rotational speed N are the combustion start timings of the cylinders. This is due to the fact that as combustion occurs the instantaneous rotational speed begins to increase. On the other hand, at each of the timings $t_2, t_4, \ldots t_{16}$, the instantaneous rotational speed N begins to decrease. Just prior to each of the successive timings at which ignition takes place, the instantaneous rotational speed N reaches a minimum value. For this reason, the instantaneous rotational speed N of diesel engine 3 varies in a periodic manner, with the period of this variation corresponding to $\frac{1}{2}$ of a full rotation of crankshaft 4.

Strictly speaking, in some cases the minimum points of the instantaneous rotational speed N may not correspond to the top dead center positions of the pistons during compression within the cylinders and also the maximum points may not correspond to the points delayed from the top dead center by 90°. However, for ease of description, it will be assumed in the following that the minimum points do correspond to the top dead center points and the maximum points to the points delayed from the top dead center by 90°.

The four cylinders of diesel engine 3 will be designated as cylinders $C_1$, $C_2$, $C_3$ and $C_4$ respectively, with the combustion process being initiated for cylinders $C_1$ to $C_4$ at timings $t_1$, $t_3$, $t_5$ and $t_7$ respectively. In the following description, this sequence of combustion start timings for the cylinders will be assumed.

The relationships between the rising-up points of the a.c. signal AC, i.e., the timings of which are indicated by these rising-up points and the timings of the respective cylinders, are detected as follows. A needle valve lift pulse signal $NLP_1$ is produced from a needle valve lift sensor 9 of a fuel injection valve (not shown) which is mounted on cylinder $C_1$, and is input to a timing detector 10 as a reference timing signal. As shown in FIG. 2C, the needle valve lift pulse signal $NLP_1$ is output just prior to each of the combustion start timings of the cylinder $C_1$, i.e., at timings $t_1, t_9, t_{17}, \ldots$. The timing detector 10 is composed mainly of a binary counter which counts input pulses in correspondence with the positive-going pulses of the a.c. signal AC, and is reset by the needle valve lift pulse signal $NLP_1$. Binary data representing the results of this counting are output as discrimination data $D_i$. In this way, it is possible easily to distinguish the correspondence between any given rising-up point of the a.c. signal AC and the cylinder having a corresponding operation timing. The discrimination data $D_i$ is output through a changeover switch SW (described in the following) to be input to a speed detector 8.

Figure 3:
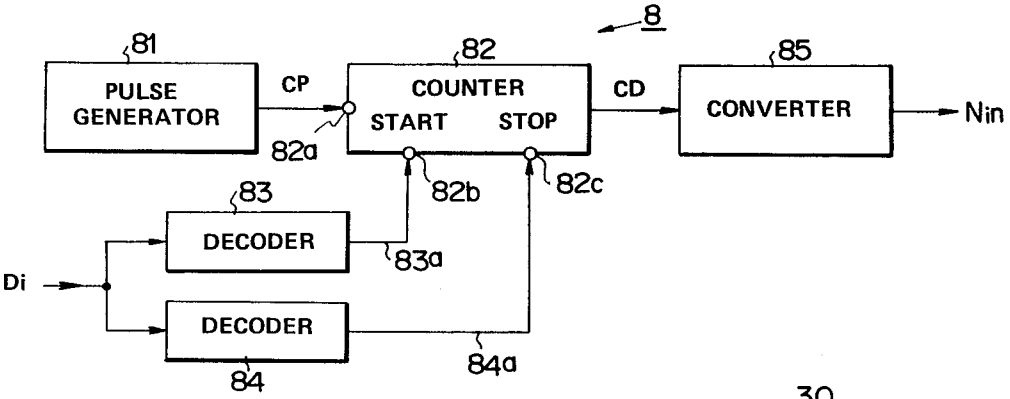
FIG. 3 is a detailed block diagram of the speed detector shown in FIG. 1.

The speed detector 8 serves to measure the time intervals $\theta_{11}, \theta_{21}, \ldots \theta_{41}, \theta_{12}, \theta_{22}, \ldots$ which are required for the crankshaft 4 to rotate through 90° following the combustion start timing in each cylinder, the measurement being performed on the basis of the a.c. signal AC. FIG. 3 is a circuit diagram showing a specific example of the speed detector 8. As shown in FIG. 3, the speed detector 8 includes a pulse generator 81, which outputs count pulses CP generated at a constant frequency which is higher than that of the a.c. signal AC. The speed detector 8 also includes a counter 82, for counting the number of the pulses CP. Counter 82 is provided with an input terminal 82*a* for receiving count pulses CP, a start terminal 82*b* for receiving start pulses, which are used to reset the counter 82 and to start counting operations, and a stop terminal 82*c* for receiving stop pulses. These stop pulses act to halt counting operations by counter 82, and to hold the count contents unchanged. Output lines 83*a* and 84*a* of decoders 83 and 84 are connected to the terminals 82*b* and 82*c* respectively, and the discrimination data $D_i$ is applied to decoders 83 and 84.

As described above, the discrimination data $D_i$ expresses a count value of a number of positive-going pulses within the a.c. signal AC, with the pulse counting being performed by a counter which is reset by the needle valve lift pulse signal $NLP_1$. In the embodiment shown in FIG. 1, the timing detector 10 is constructed in such a way that the discrimination data $D_i$ is set to zero when the timing detector 10 is reset by the signal $NLP_1$. Thus, as shown in FIG. 2D, the contents of the discrimination data $D_i$ will be 1 at timing $t_1$, 2 at timing $t_2$, and 3 at timing $t_3$, i.e., the discrimination data $D_i$ is incremented by one each time a positive-going pulse of the a.c. signal AC is generated, and thus reaches a value of 8 at time $t_8$. Immediately prior to timing $t_9$, the discrimination data $D_i$ is reset to zero by the application of the needle valve lift pulse signal $NLP_1$. Subsequently, the contents of the discrimination data $D_i$ will once more sequentially change as described above.

Each time the discrimination data $D_i$ assume any of the values 1, 3, 5 or 7, the level of output line 83*a* of the decoder 83 will go high for a short time to apply a start pulse to the start terminal 82*b* of the counter 82. On the other hand, when the discrimination data $D_i$ assumes any of the values 2, 4, 6 or 8, the output line 84*a* of the decoder 84 goes to high for a short time, and as a result, a stop pulse is applied to the stop terminal 82*c* of the counter 82.

Thus, the counter 82 counts the clock pulses CP following each of the combustion start timings ($t_1$, $t_3$, $t_5$, . . .) during an interval which extends until the crankshaft 4 has rotated through 90°. The counter 82 thereby produces as output the count data CD, which corresponds to one of the intervals $\theta_{11}$, $\theta_{21}$, . . . $\theta_{41}$, $\theta_{12}$, . . . . The count data CD is applied to a converter 85 and the count data CD is thereby converted into data representing each of the time intervals $\theta_{11}$, $\theta_{21}$, . . . . This converted data is output sequentially as the instantaneous speed of rotation, which expresses the engine's instantaneous speed of rotation immediately following combustion in a cylinder.

The converted data also represents the magnitude of the output power of the cylinder in which combustion occurs at this time.

As described in the foregoing, data expressing each of the time intervals $\theta_{11}$, $\theta_{21}$, . . . , each of which extends from a rising-up point of the a.c. signal AC (corresponding to the combustion start timings for the engine cylinders) until the succeeding rising-up point timing, are output from the speed detector 8. In the following, the instantaneous speed data which expresses the instantaneous rotational speed with respect to cylinder $C_i$ will be expressed in terms of a sequence in which detection is performed by the speed detector 8, that is to say, in the general for $N_{in}$ (where $n=1, 2, \ldots$).

The contents of the instantaneous speed data $N_{in}$ output from the speed detector 8 will therefore be as shown in FIG. 2E.

Referring to FIG. 1, the instantaneous speed data $N_{in}$ is input to an average value calculator 11, whereby the average speed of the diesel engine 3 is calculated. Numeral 12 denotes a target speed calculator, which calculates a target idling rotation speed on the basis of the operating status of the diesel engine 3 at each instant, and produces target speed data $N_t$ showing the results of this calculation. Target speed calculator 12 has a well-known type of configuration, in which target speed data $N_t$ is produced to indicate the optimum speed of idling rotation, based on the operating status of the diesel engine 3 as expressed by predetermined operating data OD for the diesel engine 3. Thus, no detailed description of the configuration of the target speed calculator 12 will be given herein. In this case, instead of using the target speed calculator 12, it is equally possible to employ a configuration whereby constant data, determined on the basis of a requisite target speed, are produced. Thus, the circuit configuration for producing target speed data $N_t$ is not limited to that shown in FIG. 1.

The target speed data $N_t$ is input to an adder 13, to which the average speed data $\overline{N}$ output from the average value calculator 11 is also input, whereby the average speed data $\overline{N}$ and target speed data $N_t$ are added together, with the polarities shown in FIG. 1. The result of this addition is input, as error data $D_e$, to a first PID (Proportional, Integrational and Differential) calculator 14, in which data processing for PID control is carried out.

The results of the calculation from the first PID calculator 14 are output as an injection amount dimension data $Q_{ide}$, which is transferred through an adder 15 to be input to a converter 16. The average speed data $\overline{N}$ is also input to the converter 16. In this way, data $Q_{ide}$ is converted into a target position signal $S_1$, which expresses a target value for the position of an injection amount regulating member 17, i.e., a value for this position which is such as to bring the error data $D_e$ to zero. A position sensor 18 serves to detect the successive positions to which injection amount regulating member 17 is set, in order to enable adjustment of the amounts of fuel injected by fuel injection pump 2. For this purpose, the position sensor 18 produces as output an actual position signal $S_2$, which indicates the position at which the injection amount regulating member 17 is currently set. This actual position signal $S_2$ is added to the target position signal $S_1$ from converter 16 by an adder 19 with the polarities shown in FIG. 1.

The addition output signal from adder 19 is input to a second PID calculator 20, and after signal processing to execute PID control, the signal from the second PID calculator 20 is input to a pulse width modulator 21. As a result, the pulse width modulator 21 produces a pulse signal PS which has a duty ratio determined in accordance with the output from the second PID calculator 20. The pulse signal PS is applied through a drive circuit 22 to an actuator 23, for controlling the position of the injection amount regulating member 17. In this way, the injection amount regulating member 17 implements position control such that the diesel engine 3 attains idling operation at the target idling engine speed.

By means of the closed loop control system described in the above, which responds to the average engine speed and to the actual position of the injection amount regulating member 17, the rotation of diesel engine 3 is controlled so that it coincides with the predetermined target idling speed.

The apparatus 1 also comprises another closed loop control system, for implementing control of individual cylinders, i.e., the "individual cylinder control", whereby an identical output is produced from each of the cylinders of the diesel engine 3. This closed loop control system will now be described.

The closed loop control system for individual cylinder control acts to adjust the fuel supplied to each of the cylinders in a manner which tends to reduce to zero the differences among the outputs of the respective cylinders. This control loop comprises a speed difference calculator 24 which calculates the differences between the values of instantaneous engine speed representing the instantaneous angular velocity for each of the cylinders $C_1$ to $C_4$, based upon the instantaneous engine speed data $N_{in}$, and a reference instantaneous engine speed for a cylinder which has been predetermined as a reference cylinder. In the present embodiment, the difference between the instantaneous engine speed for a cylinder which is under consideration and the instantaneous engine speed of the cylinder immediately prior thereto is utilized. Thus, the difference data $N_{11}-N_{21}$, $N_{21}-N_{31}$, $N_{31}-N_{41}$, . . . are sequentially output from the speed difference calculator 24 as difference data $D_d$. The output timings of these speed difference data are as shown in FIG. 2F. It is desirable that the instantaneous engine speed values for the cylinders become identical, i.e., that the value of the difference data $D_d$ become zero. For this reason, the difference data $D_d$ is added in an adder 25 to the reference data $D_r$ which is zero with the polarities shown in FIG. 1. The reference data $D_r$ is supplied from a reference data generator 32. The result of this addition operation is output as control data $D_0$, whose magnitude is the fuel injection amount, after undergoing the requisite processing for PID control by a third PID calculator 26. The average speed data $\overline{N}$ is updated each time new instantaneous engine speed data $\overline{N}$ is output from the speed detector 8. Thus, the contents of data $\overline{N}$ will be as shown in FIG. 2G, i.e., will vary in the sequence $N_1$, $N_2$, . . . .

An output controller 27 serves to control the output timing of the control output data $D_0$ based upon the difference data $D_d$. This output timing is controlled, as described in the following, in accordance with the discrimination data $D_i$.

The control output data $D_0$ produced at any particular timing will be based upon difference data relating to two of the cylinders, $C_i$ and $C_{i+1}$. The control output data $D_0$ is produced at a value for controlling the fuel adjustment operation subsequent to combustion in the cylinder $C_{i+1}$. The data $D_0$ is added to the idle amount data $Q_{ide}$ which is output from the first PID calculator 14 at that time, in the adder 15. Thus, for example, the difference data $N_d(=N_{11}-N_{21})$ for timing $t_4$ will express the instantaneous engine speed difference between the cylinders $C_1$ and $C_2$The data $D_0$ will therefore be output at a time which is at least slightly prior to timing $t_{11}$ at which the cylinder $C_2$ next begins the power stroke, and subsequent to a timing $t_9$ at which combustion begins in the cylinder $C_1$. Thus, in this case, the control data $D_0$ which is based on the difference $N_{11}-N_{21}$ is added to the idling amount control data $Q_{ide}$ which corresponds to the average speed data $\overline{N}_3$. As a result, position control of the injection amount regulating member 17 is executed in a manner which tends to reduce the preceding speed difference $N_{11}-N_{21}$ towards zero, that is to say control is performed so as to cause the values of instantaneous engine speed for the cylinders $C_1$ and $C_2$ to become identical.

In the same way as described above, the output controller 27 implements control to reduce the speed difference between the cylinders $C_2$ and $C_3$, the difference between the cylinders $C_3$ and $C_4$, and that between the cylinders $C_4$ and $C_1$, respectively towards zero. The operation in each case is identical to that whereby the difference for the cylinders $C_1$ and $C_2$ is reduced to zero. In this way, control is successively performed for each cylinder such as to reduce the amount of fuel supplied to the cylinders in a manner tending to make the outputs from the cylinders become mutually identical.

A switch 29 which is controlled to be set to the on or off state by a loop controller 28 is connected at the output of the output controller 27. The switch 29 is set to the closed state, thereby implementing individual cylinder control as described above, only when the loop controller 28 detects that predetermined conditions have been satisfied which indicate that individual cylinder control can be performed in a stable manner. When these conditions are satisfied, the loop controller 28 produces a switch control signal $S_3$, whereby the switch 29 is closed. However if these predetermined conditions are not satisfied, then the switch control signal $S_3$ will hold the switch 29 in the open state, whereby individual cylinder control is inhibited. In this way, instability of idling operation resulting from cylinder control will be effectively prevented. In addition, in this embodiment, in order to improve the response characteristics, at the same time that the switch 29 is closed by the loop controller 28, the frequency of pulse signal PS which is output from the pulse width modulator 21 is changed to a specific frequency which is unaffected by the speed of rotation of the diesel engine 3.

In order to perform control of angular speed of rotation by individual cylinder control as described above, it is desirable for the idling speed of rotation to have already attained a stable value which is within a specific range of speeds with respect to a desired target speed value. This is in order to ensure that good individual cylinder control will be achieved, in the manner described above, only in the event that the change in an engine speed due to the dispersion of the fuel injection system and the internal combustion engine occurs in a regular periodic fashion. If individual cylinder control were to be carried out during engine acceleration, or when some abnormality has arisen in the control system, instability of idling operation would result.

With the present embodiment of the invention, therefore, the following conditions must be satisfied before cylinder control is executed. Firstly, the difference between the target idling speed of rotation and the actual idling speed of rotation must always remain no greater than a predetermined value $a_1$ over a predetermined time interval. Secondly, the amount of depression of the accelerator pedal must be not more than a predetermined value $a_2$. Finally, the temperature $T_w$ of the engine coolant must be not less than a predetermined temperature $T_r$. Only when these three conditions are satisfied will switch 29 be closed, to configure the control loop which performs individual cylinder control.

On the other hand, if at least one of the following conditions occurs, the switch 29 will be opened, and individual cylinder control will be terminated. These conditions are, firstly, that the difference between the target idling speed of rotation and the actual idling speed of rotation has become higher than a predetermined value $a_3$ (where $a_3 \geqq a_1$); secondly, that the amount of depression of the accelerator pedal has exceeded a predetermined value $a_4$ (where $a_4 \geqq a_2$); thirdly, that some form of abnormality has developed in the control system. When the switch 29 is opened, in such a case, then closed loop control is thereafter only performed to control the injection amount regulating member 17 in accordance with average speed data in such a manner as to bring the idling speed of rotation to the predetermined target value.

To assure the further stable operation of the individual cylinder control even when the individual cylinder control loop is formed in response to the closing of the switch 29 and the control condition in the control system is changed, the switch control signal $S_3$ is applied to the first PID calculator 14 to change the coefficients for control in the first PID calculator 14. The switch control signal $S_3$ is mainly used as a control signal for changing the proportional constant for a proportional control part and the integration constant for an integral control part. The proportional constant and the integral constant are set at such a value that the vibration of the engine will be minimized during the time when the individual cylinder control operation is effected. The optimum set values for these constants depend upon, for example, the engine type and the like, and will be set experimentally. Consequently, in some cases, these constants are set at a value close to zero.

When the proportional constant and the integral constant for the first PID calculator 14 are changed to small value, respectively, in the case where the individual cylinder control operation is performed, it follows that the component corresponding to the proportional control plus the integral control of the control based on the average engine speed remains small. As a result, the calculation for PID control is carried out only for the component of the individual cylinder control by the third PID calculator 26. Consequently, in the individual cylinder control operation, the fuel regulating operation according to the closed-loop control for individual cylinder control becomes more dominant than the control according to the average engine speed data, so that the control of the idling engine speed can be performed in stable condition by the individual cylinder control mode. On the other hand, when the individual cylinder control is not effected, i.e., the switch 29 is not closed, the proportional constant and the integral constant set in the first PID calculator 14 are returned to the predetermined values so that the control for bringing the average engine speed to the target value is carried out. In addition, the proportional and integral constants to be set in the case where the individual cylinder control mode is selected is not limited to that in the above embodiment, they can be determined at an appropriate value suitable for the condition of the system at that time.

In the case where the operation timing for each cylinder required for conducting the individual cylinder control is detected in the timing detector 10 on the basis of the a.c. signal AC and the needle valve lift pulse signal $NLP_1$, timing detection operation by the timing detector 10 becomes impossible if, for example, the needle valve lift sensor 9 malfunctions, so that it becomes impossible to carry out the said individual cylinder control operation. If this condition is not remedied, idling control becomes unstable. In order to avoid this, the apparatus 1 has a back-up timing detector 30 for detecting the operation timing in each cylinder on the basis of only the a.c. signal AC, and back-up discrimination data $D_j$ indicating the result detected by the back-up timing detector 30 is applied to the switch SW.

For detecting whether or not the needle valve lift sensor 9 is malfunctioning, there is provided a trouble detector 31 which receives the needle valve lift pulse signal $NLP_1$, the average speed data $\overline{N}$ and the actual position signal $S_2$. The trouble detector 31 discriminates whether the diesel engine 3 is being operated in the no-injection region on.the basis of the average speed data N and the actual position signal $S_2$ when output of the needle valve lift pulse signal $NLP_1$ from the needle valve lift sensor 9 ceases, and produces a switching signal HS when the operation of the diesel engine 3 is not in the no-injection region. The switch SW is switched over from the state shown by a solid line to the state shown by a broken line in response to the application of the switching signal HS, so that the back-up discrimination data $D_j$ instead of the discrimination data $D_i$ is supplied to the speed detector 8 and the output controller 27.

Figure 4:
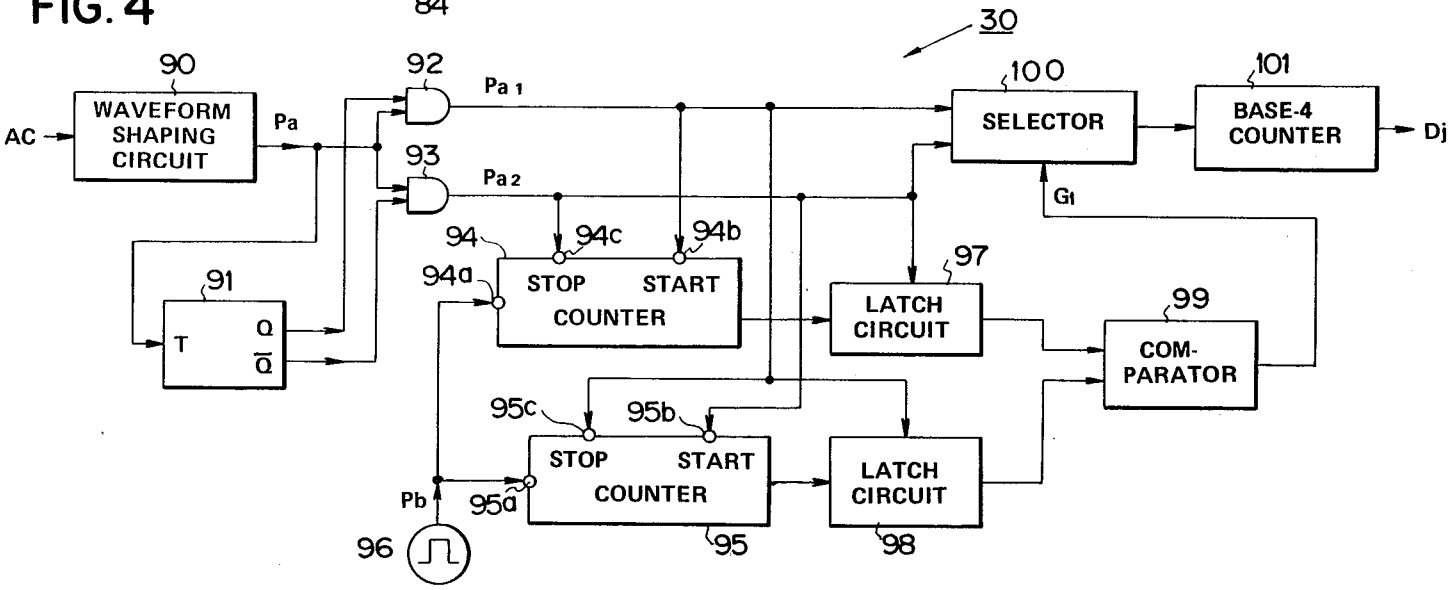
FIG. 4 is a detailed block diagram of the back-up timing detector shown in FIG. 1.
Figures 5A, 5B, 5C, 5D, 5E, 5F, 5G, 5H, 5I:
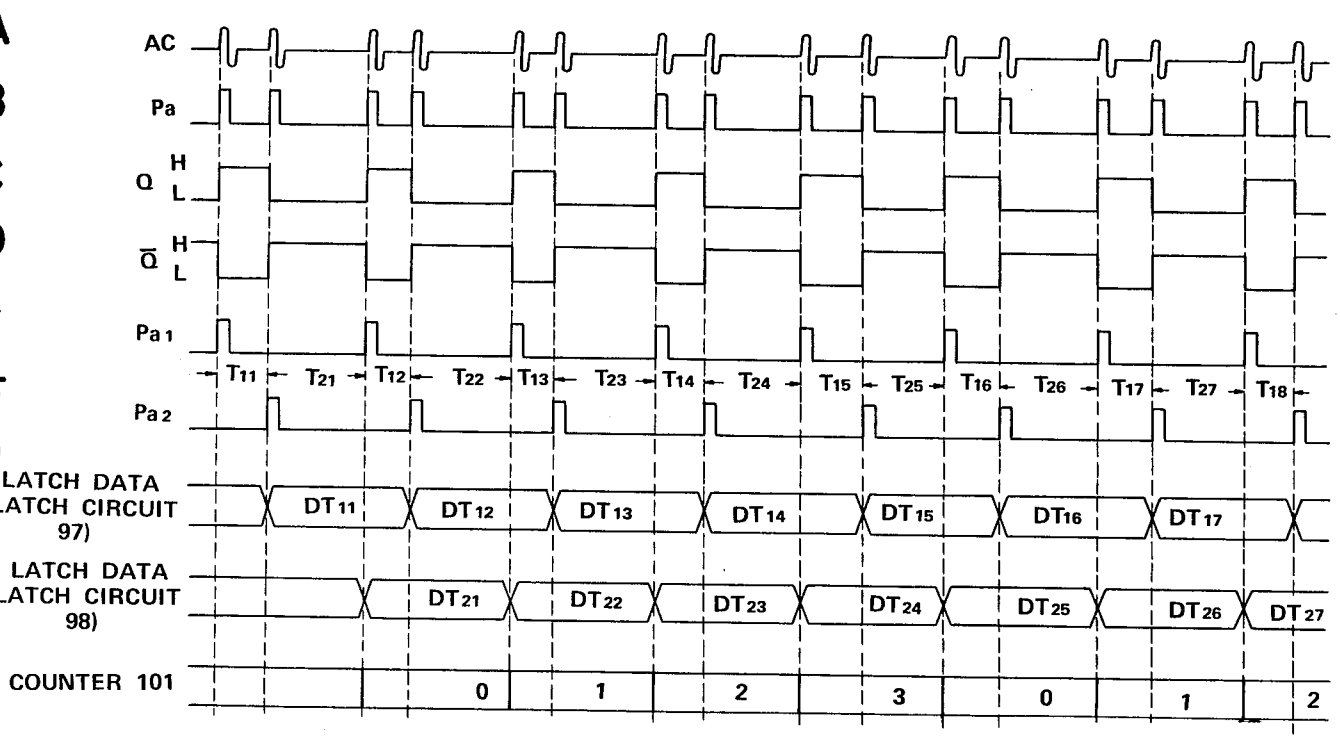
FIGS. 5A to 5I are timing charts for explaining the operation of the back-up timing detector shown in FIG. 4.

FIG. 4 is a detailed block diagram showing a circuit construction of the back-up timing detector 30. The back-up timing detector 30 has a waveform shaping circuit 90 for shaping the waveform of the a.c. signal AC (see FIG. 5A), from which a base pulse train signal $P_a$ is formed by pulses corresponding to the positive-going pulses of the a.c. signal AC. The base pulse train signal $P_a$ is applied to a T flip-flop 91 which operates in response to the timing of the leading edge of each pulse of the base pulse train signal $P_a$ to produce Q output and $\overline{Q}$ output (FIGS. 5C and 5D).

The base pulse train signal $P_a$ is applied to one input terminal of AND gates 92 and 93, the other input terminals of which receive the Q output and $\overline{Q}$ output, respectively. Therefore, the AND gate 92 is opened only when the Q output is high, while the AND gate 93 is opened only when the $\overline{Q}$ output is high. As a result, every other pulse of the pulses forming the base pulse train signal $P_a$ are derived from the AND gate 92 to obtain a first pulse train signal $P_{a1}$ (FIG. 5E). On the other hand, the other pulses of the base pulse train signal $P_a$ which do not form the first pulse train signal $P_{a1}$ are derived from the AND gate 93 to obtain a second pulse train signal $P_{a2}$ (FIG. 5F).

Therefore, as described hereinbefore, the top dead center timing of the pistons just before the power stroke in each cylinder can be indicated by the pulses of the pulse train signal derived from either of the AND gates 92 and 93. As will be easily understood from FIG. 5A or 5B, in this case, the pulses of the first pulse train signal $P_{a1}$ indicate the timing of top dead center of the pistons just before the power stroke of a cylinder. To discriminate the matter described above on the basis of the difference in time interval between the two serial pulses of the base pulse train signal $P_a$ without the use of the needle valve lift pulse signal $NLP_1$, there are provided counters 94 and 95 which are controlled by the first and second pulse train signals $P_{a1}$ and $P_{a2}$ These counters 94 and 95 have the same construction as that of the counter 82 shown in FIG. 3. Count pulses $P_b$ produced by a pulse generator 96 at a sufficiently short period, as compared with that of the a.c. signal AC, are applied to input terminals $\mathbf{94}_a$ and $\mathbf{95}_a$. The first pulse train signal $P_{a1}$ is applied to a start terminal $\mathbf{94}_b$ of the counter 94 and a stop terminal 95*c* of the counter 95 and the second pulse train signal $P_{a2}$ is applied to a stop terminal $\mathbf{94}_c$ of the counter 94 and a start terminal $\mathbf{95}_b$ of the counter 95. Therefore, the counter 94 is reset by a pulse of the first pulse train signal $P_{a1}$ to start the counting operation for counting the number of the count pulses $P_b$ generated. After this, the counting operation of the counter 94 is stopped in response to the first generation of a pulse of the second pulse train signal $P_{a2}$ thereafter and the content of the counter 94 is maintained. The output data from counter 94 is applied to a latch circuit 97 for latching its input data in response to the second pulse train signal $P_{a2}$, so that the counted result of the counter 94 is immediately latched by the latch circuit 97.

The counter 95 starts to count in response to pulses of the second pulse train signal $P_{a2}$ and stops counting in response to a pulse of the first pulse train signal $P_{a1}$. The counted result of the counter 95 is latched in a latch circuit 98 in response to a pulse of the first pulse train signal $Pa_1$.

Therefore, the counter 94 produces data $DT_{11}$, $DT_{12}$, $DT_{13}$, corresponding to times $T_{11}$, $T_{12}$, $T_{13}$, . . ., respectively, each of which indicates the time from a pulse of the first pulse train signal $P_{a1}$ to the next pulse of the second pulse train signal $P_{a2}$, and these data are latched by the latch circuit 97 at the time described above (see FIGS. 5E, 5F and 5G). Similarly, the counter 95 produces data $DT_{21}$, $DT_{22}$, $DT_{23}$, . . . corresponding to the times $T_{21}$, $T_{22}$, $T_{23}$, . . ., respectively, each of which indicates the time from a pulse of the second pulse train signal $P_{a2}$ to the next pulse of the first pulse train signal $P_{a1}$, and these data are latched by the latch circuit 98 at the time described above (see FIGS. 5E, 5F and 5H).

The data latched by the latch circuits 97 and 98 are applied to a comparator 99 which discriminates which is the lesser. Data $G_1$ indicating the result of the discrimination is applied as a select control data to a selector 100 which receives the first and second pulse train signals $P_{a1}$ and $P_{a2}$ The selector 100 is for selectively deriving either the first pulse train signal $P_{a1}$ or second pulse train signal $P_{a2}$ in such a way that a pulse train signal which is applied as a latch signal to the latch circuit latches the latch circuit with the larger data. In this case, since the content latched by the latch circuit 98 is greater than the content latched by the latch circuit 97, the first pulse train signal $P_{a1}$ which is applied to the latch circuit 98 is selected by the selector 100, and is applied as a count pulse signal to a base-4 counter 101. That is, it follows that a pulse train signal formed of pulses showing top dead center timing of the piston just before the power stroke of the cylinder is selected on the basis of the counts of the counters 94 and 95.

Consequently, the count of the base-4 counter 101 is incremented by one at each pulse of the first pulse train signal $P_{a1}$ as shown in FIG. 5I and repeats the count from 0 to 3. As a result, the output data from the base-4 counter 101 indicates in which cylinder the piston is on its combustion stroke at that time, and is produced as the back-up discrimination data $D_j$.

It is impossible to indicate in which of the cylinders $C_1$ to $C_4$ is the power stroke occurring merely just on the basis of the content of the back-up discrimination data $D_j$. However, as will be understood from the above description, individual cylinder control is not impeded and can be carried out normally by the use of the back-up discrimination data $D_j$.

Thus, it is possible to carry out the individual cylinder operation normally, even if the needle valve lift sensor 9 malfunctions.

In this embodiment, the back-up system is arranged in such a way that the back-up discrimination data $D_j$ is provided to the control system only when the needle valve lift sensor 9 malfunctions. However, the circuit shown in FIG. 4 can be provided instead of the timing detector 10 and the discrimination data from the circuit shown in FIG. 4 be constantly supplied to the speed detector and the output controller 27.

With this arrangement, the control for suppressing the transient changes such as an under-shoot of the engine speed, the control for maintaining the idling engine speed approximately at the target speed and the like are performed by the closed-loop control in which an average speed of the diesel engine and a signal indicative of the actual position of the injection amount regulating member are used as feedback signals, so that the stable state of the idling operation of the engine is established. Under such a stable condition, the individual cylinder control is carried out in such a way that an identical output is produced from each of the cylinders of the engine. When the individual cylinder control is executed, the magnitudes of the proportional control constant and of the integral control constant used for the average engine speed control are reduced, so that the individual cylinder control is effectively carried out.

Furthermore, since there are provided the back-up timing detector 30 and the trouble detector 31 in order to perform the individual cylinder control operation even when the needle valve lift sensor 9 is malfunctioning, the reliability of the apparatus is remarkably increased.

In addition, in the control region where the idling speed of the engine is close to the target speed, the control gain of the closed-loop for controlling the average engine speed is set relatively low, and the operation of the individual cylinder control is not effected so much.

Furthermore, in the embodiment described above, detection of the angular velocity for each cylinder is performed on the basis of the time required for the crankshaft to rotate through 90° from the top dead center position of the compression stroke of the cylinder concerned. This enables variations in the torque produced following combustion to be most readily detected, and results in enhancement of the control characteristics.

Figure 6:
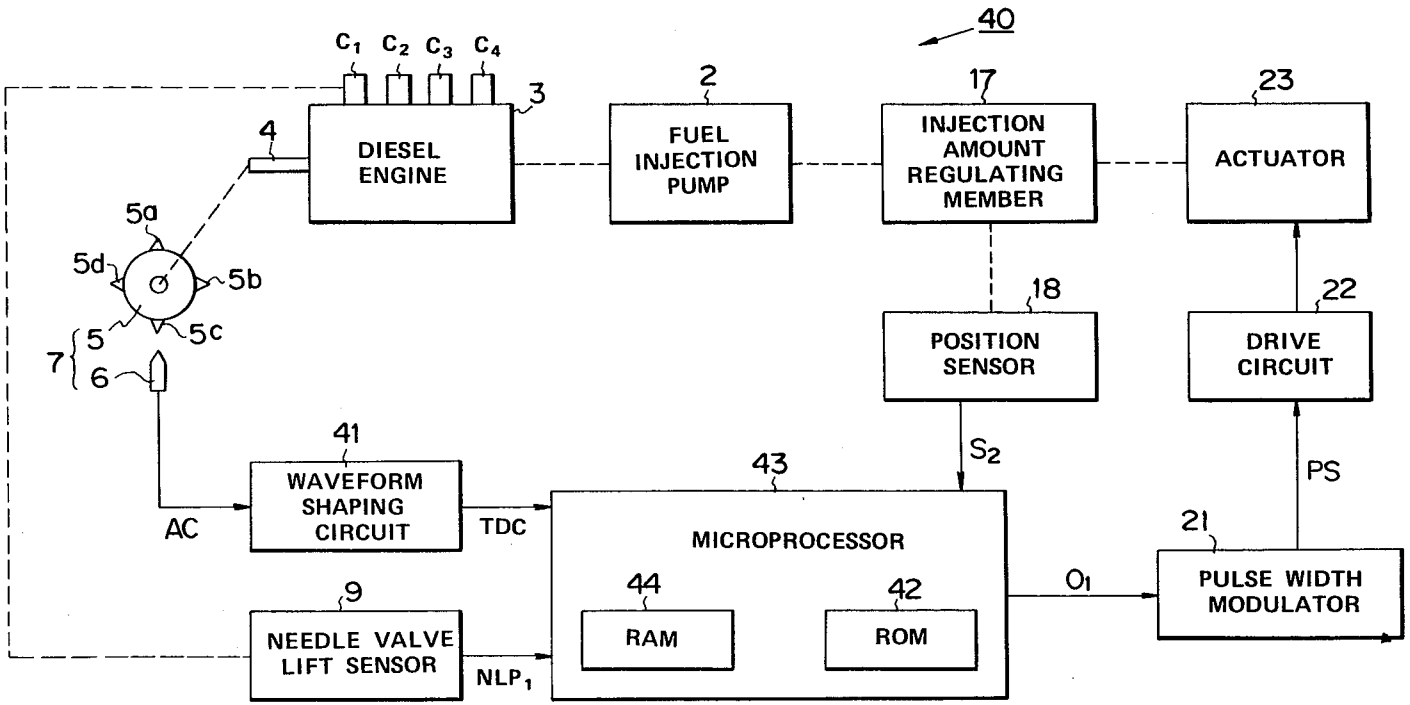
FIG. 6 is another embodiment of the present invention employing a microprocessor.

FIG. 6 shows another embodiment of the present invention, in which the idling operation control apparatus is implemented by a microcomputer or microprocessor. Those parts of the idling operation control apparatus 40 shown in FIG. 6 which are identical to the corresponding portions shown in FIG. 1 are indicated by identical reference numerals to those of FIG. 1, and further description of these will be omitted. Numeral 41 denotes a waveform shaping circuit, which produces output pulses corresponding to the positive-going pulses of the a.c. signal AC. These pulses are output as top dead center pulses TDC. The TDC pulses, the needle valve lift pulse signal $NLP_1$ from the needle valve lift sensor 9 and the actual position signal $S_2$ from the position sensor 18, are applied to a microprocessor 43, which is equipped with a read-only memory (ROM) 42. The ROM 42 stores a control program therein, which performs a substantially identical function to the idling control functions of the apparatus shown in FIG. 1. This control program is executed by the microprocessor 43, thereby performing the control to produce a specific idling rotation speed. The microprocessor 43 produces an output signal $O_1$ indicating the results of calculation to control the injection amount and the signal $O_1$ is supplied to the pulse width modulator 21.

Figure 7:
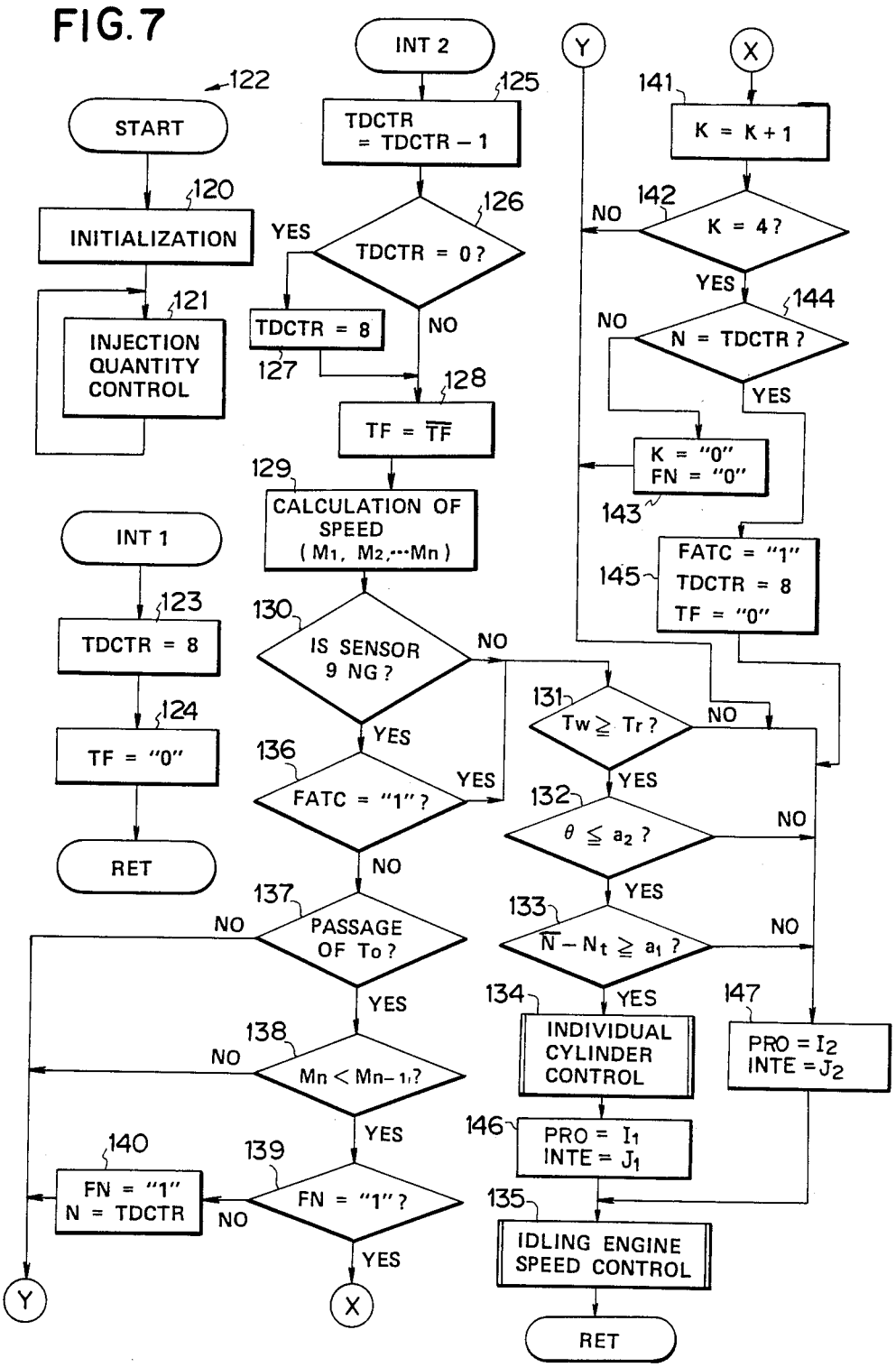
FIG. 7 is a flow chart showing a control program executed in the microprocessor in the apparatus shown in FIG. 6.

FIG. 7 shows a flow chart of the control program to be stored in the ROM 42. The control program consists of a main control program 122 having a step 120 in which operation is initialized after the start of the program and a step 121 for carrying out position control of the injection amount regulating portion as well as the calculation of a target fuel injection amount in accordance with the operation of an accelerator pedal, an interrupt program INT 1 to be executed in response to the output of the needle valve lift pulse signal $NLP_1$, and another interrupt program INT 2 to be executed in response to the output of a top dead center pulse TDC.

In step 123 of the interrupt program INT 1, first the content of a counter TDCTR is set at 8, and a flag TF is set at "0" in step 124, terminating the execution of the operation. The flag TF is for determining if the calculation of the fuel injection amount data $Q_i$ should be performed or the data $Q_i$ being calculated should be produced in the interrupt program INT 2. The interrupt program INT 2 is executed in response to the generation of the top dead center pulse TDC and the content of the counter TDCTR is decremented by one in step 125. The operation then moves to step 126, where a first decision is made as to whether the content of the counter TDCTR is equal to zero. If the decision is YES, that is TDCTR=0, the operation moves to step 127, where the counter TDCTR is set at 8, and then to step 128 where inversion of the flag TF is carried out.

On the other hand, if the decision in step 126 is NO, operation moves straight to step 128, where the inversion of the flag takes place. Calculation of data $M_1$, $M_2$, . . . indicative of the time interval between adjacent pulses (which correspond to the times $T_{11}$, $T_{21}$, $T_{12}$, . . . in FIG. 5) is carried out and the engine speed is calculated in step 129 in accordance with the result of the calculation.

In step 130, another decision is made as to whether the needle valve lift sensor 9 is defective or malfunctioning. The decision is made in such a manner that when the content of the counter TDCTR is larger than the predetermined value of 8 and a fuel injecting condition is detected, it is determined as having failed (NG). If the needle valve lift sensor 9 is not in an NG condition, the operation moves to steps 131 to 133, where, respectively, a decision is made as to whether the coolant temperature $T_w$ of the engine 3 is above a predetermined value of $T_r$, a decision is made as to whether the operation amount $\theta$ of the accelerator pedal is below a predetermined value of $a_2$, and whether the difference $\overline{N}-N_t$ between the target idling engine speed $N_t$ and the average idling engine speed $\overline{N}$ has been above a predetermined value of $a_1$ for a predetermined time period.

Only if the decision in each of the steps 131 to 133 is YES does the operation move to step 134, where the calculation for individual cylinder control is carried out in accordance with the instantaneous engine speed for the idle operation.

When the individual cylinder control operation is carried out, the operation moves to step 146 in which PI control constants used for calculation, which is for idling engine speed control based on the average engine speed and will be carried out in step 135 described below, are set. In step 146, a proportional control constant PRO and an integral control constant INTE are set at $I_1$ and $J_1$, respectively, which are small values close to zero. After this, the operation moves to step 135 in which the idling engine speed is controlled on the basis of the result of the calculation for the individual cylinder control in accordance with the average engine speed. In this control operation, the control constants $I_1$ and $J_1$ are used for PI control calculation for the average engine speed control.

On the other hand, when the decision is NO in any one of the steps 131 to 133, no calculation for individual cylinder control is carried out in the step 134, and the operation moves to step 147 where the proportional control constant PRO and the integral control constant INTE are set at $I_2$ and $J_2$, respectively. These value $I_2$ and $J_2$ are selected to be greater than the values $I_1$ and $J_2$, respectively. After this, the operation moves to step 135 where the idling engine speed control based on only the average engine speed is carried out in accordance with the set constants $I_2$ and $J_2$.

When the coolant temperature is low, the combustion within the engine does not present the same kind of characteristics since the combustion is not stable, and the amplitude of the output torque becomes unstable. As a result, it cannot be guaranteed that the periodic fluctuations of the combustion will have the same tendency in each cylinder, which is a prerequisite of the individual cylinder control. Thus, the temperature condition of the coolant is considered to be one of the factors for deciding the prerequisite in case of control of the individual cylinders. Accordingly, the condition of $T_w \geqq T_r$ is chosen for the individual cylinder control. In the above case, only when $T_w \geqq T_r$ is calculated for the individual cylinder control executed in step 134.

Figure 9:
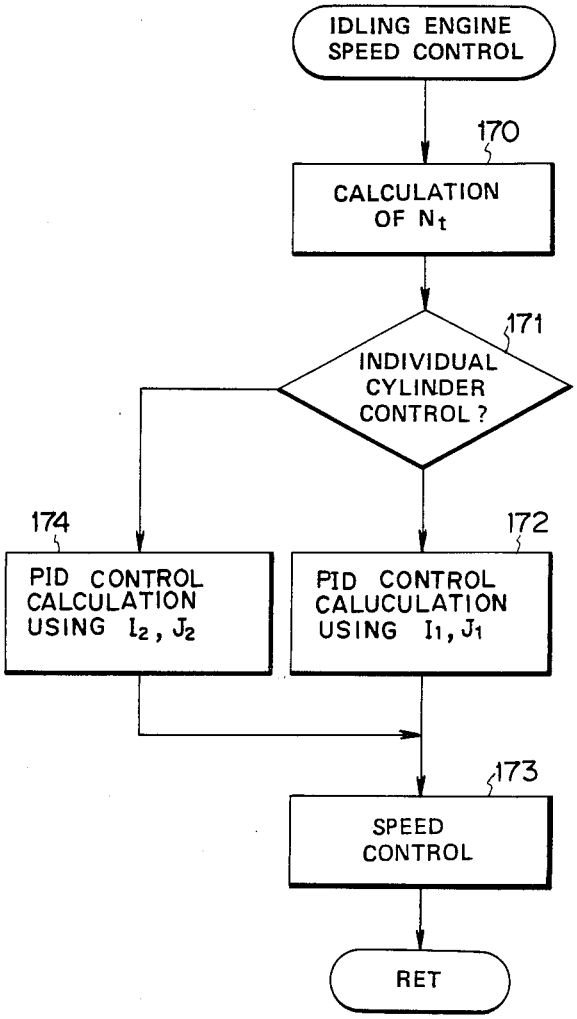

FIG. 9 shows a detailed control flow chart of the idling engine speed control to be executed in step 135. Referring to FIG. 9, in step 170 the target speed data $N_t$ is calculated, and the operation moves to step 171, where a decision is made as to whether individual cylinder control is in an executable condition. If the decision is YES, the operation moves to step 172, in which the PID control calculation is executed using the constants $I_1$ and $J_1$. In this case, the differential control constant for differential control calculation is set at a predetermined constant value in advance and this value is used. After this, the operation now moves to step 173, where the speed control is carried out to obtain the target idling engine speed $N_t$ on the basis of the result of the calculation of the injection amount for individual cylinder control and the result in step 172.

If the decision in step 171 is NO, the operation moves to step 174, where the PID control calculation is executed using the constants $I_2$ and $J_2$. In this case, the differential control constant is also set at the predetermined constant value in advance and this value is used. Then, the operation moves to step 173, where the speed control is carried out to obtain the target idling engine speed $N_t$ on the basis of the result in step 174.

Returning to FIG. 7, when the needle valve lift sensor 9 is defective, the operation moves to step 136, where a decision is made as to whether the flag FATC which indicates whether individual cylinder control should be carried out is set at "1". If the decision is YES, i.e., FATC="1", the operation moves to step 131, while if the decision is NO, i.e., FATC="0", the operation moves to step 137. In step 137, another decision is made as to whether idling operation condition has continued for a time greater than a predetermined time of $T_0$. If the decision is NO, the operation moves to step 147, while if the decision is YES, the operation moves to step 138.

In step 138, among data indicative of the time interval between successive top dead center pulses TDC, the data $M_n$ obtained in the current execution of the interrupt program INT 2 is compared in magnitude with the data $M_{n-1}$ which was obtained in the execution of the interrupt program INT 2 one time earlier. As will be appreciated from FIGS. 2A and 2B the intervals between top dead center pulses TDC alternate between a long state and a short state so that the comparison of the data $M_n$ with the data $M_{n-1}$ makes it possible to determine if the data which was obtained in the execution of the interrupt program INT 2 one time earlier. As will be appreciated from FIGS. 2A and 2B the intervals between top dead center pulses TDC alternate between a long state and a short state so that the comparison of the data $M_n$ with the data $M_{n-1}$ makes it possible to determine if the operation timing for the cylinders is in the long state or the short state.

In this case, if the condition $M_n < M_{n-1}$ is obtained, the top dead center pulse TDC by which the interrupt program INT 2 is executed at this time is the first pulse produced after one of the cylinders enters its power stroke. That is, it corresponds to one of the timings $t_2$, $t_4$, $t_6$, . . . .

On the other hand, if the condition $M_n \geqq M_{n-1}$ is obtained, the top dead center pulse TDC by which the interrupt program INT 2 is executed at this time is a pulse indicating the start of the power stroke in one of the cylinders of the engine. That is, it corresponds to one of the timings $t_1$, $t_3$, $t_5$, . . . .

Accordingly, when the decision in step 138 is NO, no calculation of the injection amount for individual cylinder control is performed and the operation moves to step 147, while if the decision is YES, the operation moves to step 139, where it is decided whether the flag FN is set at "1". The flag FN is provided for discriminating whether the decision in step 137 has become YES at least once.

When the flag FN is "0", the decision in step 139 is NO and the operation moves to step 140, where the flag FN is set to "1" and the content of the counter TDCTR is set at a variable N, and the operation moves to step 147. Accordingly, from next time the decision in step 139 becomes YES and the operation moves to step 141. In step 141, K=K+1 is established, and a decision is then made as to whether K is equal to 4, i.e., K=4, in step 142. When any of the cylinders enters its power stroke, K increases by one. If the decision in step 142 is NO, the operation moves to step 147. However, if the decision in step 142 is YES, the operation moves to step 144, where another decision is made as to whether the variable N is equal to the content of the counter TDCTR. When N=TDCTR, because one cycle has elapsed, i.e., the crankshaft 4 has rotated 720 degrees, the operation moves to step 145 where FATC="1", TDCTR=8, and TF="0" are set, and the operation moves to step 147. On the other hand, when the decision in step 144 is NO, the operation moves to step 143, where K="0" and FN=0 are established, and the operation then moves to step 147.

As described in the above, when the needle valve lift sensor 9 is detected as not having failed the operation moves directly to step 131. However, when the needle valve lift sensor 9 is malfunctioning, the data $M_{n-1}$ is compared with $M_n$ and a decision on operation timing for each of the cylinders of the engine is made. Step 134 for calculating the injection amount for each cylinder is then executed in accordance with the result of the decision.

Figure 8:
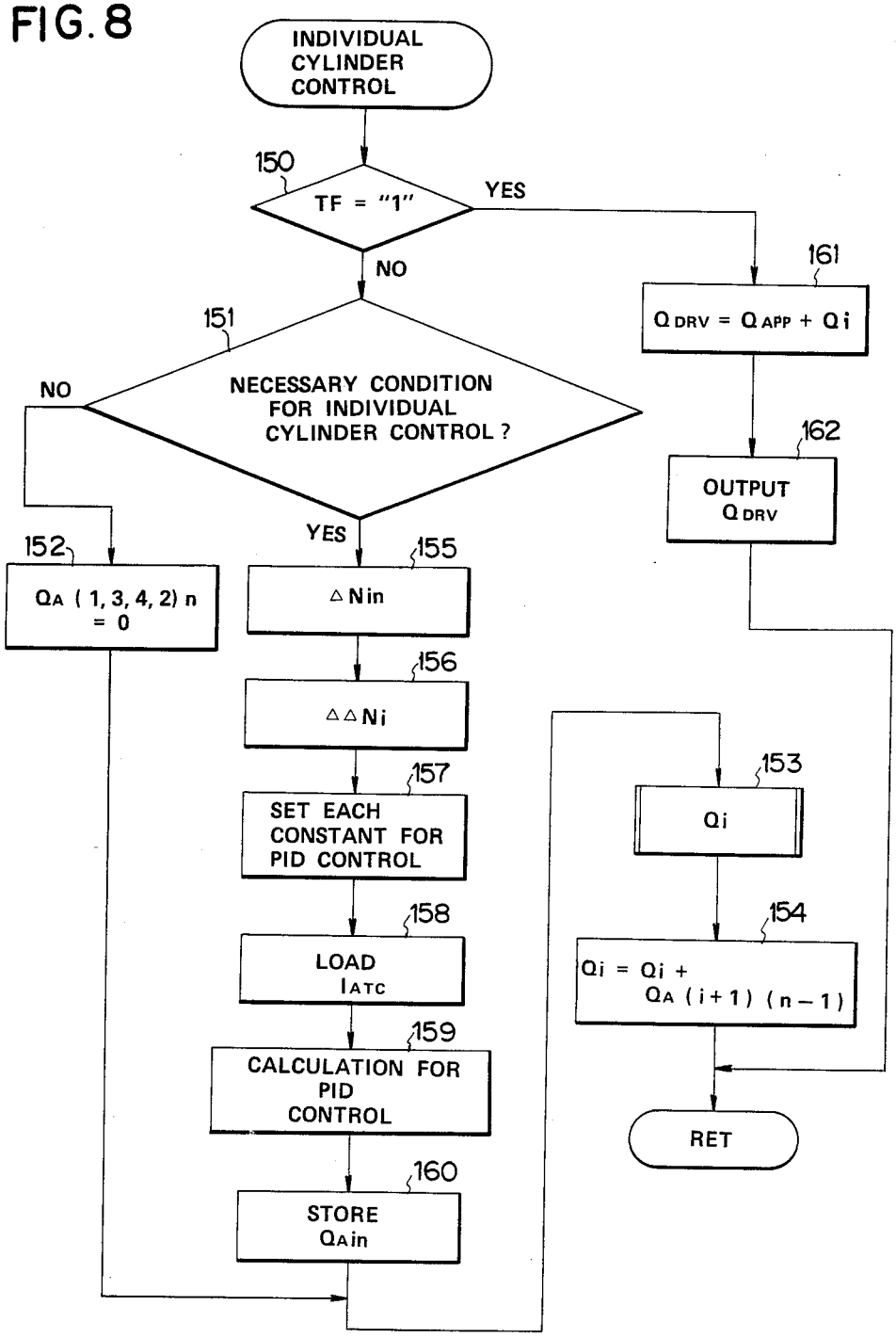
FIGS. 8 and 9 are detailed flow charts showing a part of the flow chart shown in FIG. 7.

The control and operation for the individual cylinders in step 134 will now be exlained with reference to the detailed flow chart shown in FIG. 8.

First, in step 150 the status of the flag TF is discriminated. If it is determined that TF="0", the subsequent steps for calculating the control data for each of the cylinders are executed. On the other hand, if it is determined that TF="1", the subsequent steps for deriving the control data for controlling the cylinders are executed. The status of the flag TF=0 means the condition where the top dead center pulse TDC has not yet been produced after the needle valve lift pulse signal $NLP_1$ was produced, or a condition where an even number of the top dead center pulses TDC have been already produced after the needle valve lift pulse signal $NLP_1$ was produced, but the next top dead center pulse TDC has not yet been produced. Namely, the status indicates a time period during which the cylinder has not entered the power stroke and it corresponds to each of the time periods $t_2$ to $t_3$, $t_4$to $t_5$, $t_6$ to $t_7$, . . . in FIG. 2.

On the other hand, the status of the flag TF="1" indicates the time periods during which any one of the cylinders is in the combustion process as will be understood from the foregoing description. These time periods correspond to the time periods $t_1$ to $t_2$, $t_3$ to $t_4$, $t_5$ to $t_6$, . . . in FIG. 2.

When the flag TF is "0", the operation moves to step 151, where a decision is made as to whether the operation conditions of the engine satisfy the necessary conditions for enabling the individual cylinder control to be carried out. If the decision is NO, the contents of the data indicative of the fuel injection amount $Q_{Ain}$ for individual cylinder control are made zero in step 152. In the description of this specification, the fuel injection control data for controlling each of the cylinders is indicated as $Q_{Ain}$ in general, where i indicates cylinder number and n indicates the timing calculated from the data.

After this operation, in step 163, the integral control data $I_{ATC}$ for performing the integral control is stored among the results of the calculation for the PID control. This PID control is executed in step 159, as will be described later. The integral control data obtained in step 159 just before the individual cylinder control is turned OFF is stored in a random access memory (RAM) 44 of the microprocessor 43. After this operation, the operation moves to step 153, where the calculation for obtaining the fuel injection control amount data $Q_i$ for the idle engine speed control is carried out in accordance with the average engine speed, and the operation moves to step 154.

In step 154, the injection amount control data $Q_{A(i+i)(n-1)}$ is added to the control data $Q_i$ for the next cylinder control which was calculated one cycle before. This resulting control data $Q_i$ is stored in the RAM 44 of the microprocessor 43.

If the decision in step 151 is YES, the operation moves to step 155, where the difference $\Delta N_{in}$ between the speed $N_{in}$ based on the top dead center pulse TDC output at this time and the speed $N_{(i-1)}$ based on the top dead center pulse TDC output one cycle before is calculated and the operation moves to step 156.

In step 156, from the difference $N_i$ thus obtained in step 155 and the difference $N_{i(n-1)}$ similarly obtained one cycle before, another difference $N_i$ is calculated therebetween. After this operation, each constant for performing the PID control is set up in step 157 and the operation moves to step 158, where the integral data $I_{ATC}$ for the integral control, stored in step 163, is loaded and the operation moves to step 159, where the PID control calculation is performed using these data. Accordingly, in the calculation of the PID control executed in step 159 when the individual cylinder control is changed from the OFF condition to the ON condition, the data which has been stored in the step 163 is used as integral control data $I_{ATC}$. Thus, the required result can be obtained rapidly, as compared with the case where the calculation of the PID control is again carried out from the beginning, as the integral control data is zero and the transient time of the control can be greatly improved.

The control data $Q_{Ain}$ for controlling each of the cylinders, obtained by the calculation for the PID control in step 159, is stored into the RAM 44 in step 160. Accordingly, in this case, the data value which has been stored in the step 160 and the previous value of the data $Q_i$ are added together to obtain a final data $Q_i$.

On the other hand, when the decision in step 150 is YES, the data $Q_i$ at that time is added to the control data $Q_{APP}$ determined in accordance with the amount of the operation of the accelerator pedal, so as to obtain data $Q_{DRV}$ in step 161, and the operation moves to step 162, where the data $Q_{DRV}$ is produced as fuel injection amount control data for the cylinders in which the intake stroke is in progress.

As will be understood from the foregoing description, when the needle valve lift sensor 9 is normal, the calculation of the control data for carrying out individual cylinder control and its output are controlled by the flag TF, while when the sensor 9 is faulty, the comparison of the data $M_n$ with the data $M_{n-1}$ enables determination of the timing to be executed for the individual cylinder control. Consequently, regardless of whether the needle valve lift sensor 9 is normal or faulty, suitable operation for individual cylinder control can be carried out.

In the embodiments described above, the output of the cylinder which is in combustion mode just before the cylinder to be considered becomes its combustion mode, is used as the predetermined reference value for obtaining the differential data. However, the predetermined reference value is not limited only to the above, but can also apply to the selection of, for example, the average engine speed indicated by the average speed data $\overline{N}$ or the output of a specific cylinder, as the predetermined reference value for the calculation of the differential data.

We claim:

1. An apparatus for controlling the idling operation of an internal combustion engine, said apparatus comprising:

a closed-loop control system having first and second output means, the first output means generating average rotational speed data indicating the average engine speed of a multi-cylinder internal combustion engine, the second output means generating target rotational speed data indicating a predetermined target idling speed of the engine, a first calculating means responsive to the average speed data and the target speed data for producing first control data relating to the fuel amunt to be supplied to the engine so as to obtain a target idling speed, a processing means for processing the first control data and enabling the use of the closed-loop control system for at least proportional and integral control, and means responsive to the output from the processing means for controlling a speed regulating means so as to carry out closed-loop control for iding of the engine speed;

a detecting means for detecting timing of cylinder operation of the engine and for producing corresponding output signals;

a first means responsive to the output of said detecting means for producing first data relating to the output of the respective cylinders of said engine;

a second means responsive to the first data for repeatedly calculating and producing differential data for each of the cylinders successively, the differential data being related to the difference between the outputs of the respective cylinders and a predetermined reference value;

a second calculating means responsive to the differential data for calculating and producing second control data relating to the fuel amount required for eliminating the difference between the outputs of the respective cylinders as indicated by the differential data;

output control means responsive to the output signals of said detecting means for outputting the second control data at a predetermined time before the fuel amount to be supplied to each cylinder is adjusted;

an adder unit for adding the output data from the first calculating means to the second control data;

a control means for detecting whether predetermined conditions exist for carrying out superimposed single cylinder control and for supplying the second control data to the adder stage if the predetermined conditions exist, data of the conditions detected being transferred to the first calculating means so as to alter at leat one control constant in the first calculating means.

2. An apparatus as claimed in claim 1 wherein said detecting means has first and second signal generators, the first generator generating first pulses every time the crankshaft of said engine reaches predetermined reference angular positions, the second signal generator generating second pulses every time fuel is injected into a predetermined cylinder of said engine, and a data output means responsive to said first and second pulses for producing discrimination data indicating which cylinder is in the combustion process.

3. An apparatus as claimed in claim 2 wherein said first signal generator generates the first pulse every time any of the pistons of said engine reaches its top dead center position.

4. An apparatus as claimed in claim 3 wherein said data output means has a counter which is reset by the second pulses and counts the first pulses, whereby data showing the result of the counting in the counter is output as said discrimination data.

5. An apparatus as claimed in claim 1 wherein said detecting means has a signal generator for generating a timing pulse every time the crankshaft of said engine reaches predetermined reference angular positions, and a discriminating means responsive to the timing pulse for discriminating relative operation timing among the cylinders on the basis of the periodical change in interval in the generation of the timing pulses due to the periodical change in the rotational speed of said engine.

6. An apparatus as claimed in claim 5 wherein said discriminating means has means responsive to the timing pulses for producing a first pulse train signal formed by deriving the timing pulses from each other and a second pulse train signal formed by the residual timing pulses, a decision means responsive to the first and second pulse train signals for deciding which pulse train signal is for indicating the compression top dead center timing, a selecting means responsive to the decision in said decision means for selecting a desired pulse train signal, and an n-advance counter (n being equal to the number of the cylinders of said engine) for counting the pulses of the pulse train signal selected by said selecting means, whereby the counted data obtained by said n-advance counter is derived as said discrimination data.

7. An apparatus as claimed in claim 1 wherein said detecting means has a first signal generator for generating first pulses every time a crankshaft of said engine reaches predetermined reference angular positions, a second signal generator for generating second pulses every time fuel is injected into a predetermined cylinder of said engine, a first data output means responsive to said first and second pulses for producing a discrimination data indicating which cylinder is in the combustion process, a second data output means responsive to the first pulses for discriminating relative operation timing among the cylinders on the basis of the periodical change in interval in the generation of the first pulses due to the periodic change in the rotational speed of said engine, a trouble detecting means for detecting whether said second signal generator is malfunctioning, means responsive to the output of said trouble detecting means for selecting either the discrimination data when no malfunction occurs in said second signal generator or the result of said second data output means when malfunction occurs in said second signal generator.

8. An apparatus as claimed in claim 1 wherein said first means calculates data indicating the angular velocity of the crankshaft of said engine as each cylinder enters the combustion process, and the calculated result is derived as said first data.

9. An apparatus as claimed in claim 8 wherein said second means calculates said differential data in response to said first data on the basis of the difference in angular velocity of the crankshaft of said engine at the time of the combustion process of each cylinder.

10. An apparatus as claimed in claim 1 wherein said second output means calculates said target speed data in response to a signal showing the operating condition of said engine

11. An apparatus as claimed in claim 1 wherein said control means is responsive to the temperature of a coolant for said engine and the second control data from said output control means is supplied to the closedloop control system when the temperature of the coolant exceeds a predetermined temperature.

12. An apparatus as claimed in claim 1 wherein the individual cylinder control is carried out when the difference between the target idling speed and the actual idling speed is less than a predetermined value.

13. An apparatus as claimed in claim 1 wherein the individual cylinder control is carried out when the difference between the target idling speed and the actual idling speed has been continuously less than a predetermined value for a predetermined period.

14. An apparatus as claimed in claim 1 wherein said control means changes a proportional constant and an integral constant in accordance with an the ON/OFF state of the individual cylinder control operation.

15. An apparatus as claimed in claim 14 wherein the proportional constant and the integral constant are changed to very small values when the individual cylinder operation is performed.

16. An apparatus as claimed in claim 1 wherein the predetermined reference value is the average speed value indicated by the average speed data.

17. An apparatus as claimed in claim 1 wherein the predetermined reference value is the output of a predetermined reference cylinder.

18. An apparatus as claimed in claim 17 wherein a specific cylinder is selected as the predetermined reference cylinder.

19. An apparatus as claimed in claim 17 wherein a cylinder in which the combustion is carried out just before the combustion is carried out in the cylinder for which the differential data is to be considered, is selected as the predetermined reference cylinder.

* * * * *